US006101859A

United States Patent [19]

Shieh

[11] Patent Number: 6,101,859

[45] Date of Patent: Aug. 15, 2000

[54] DIE ASSEMBLY FOR FORMING A PATTERN ON A METAL PLATE

[75] Inventor: Miko Shieh, Taichung Hsien, Taiwan

[73] Assignee: Wilshine Corp., Taichung-Hsien, Taiwan

[21] Appl. No.: 09/251,750

[22] Filed: Feb. 18, 1999

[51] Int. Cl.[7] ..... B21D 28/14

[52] U.S. Cl. ..... 72/327; 72/333; 72/414; 29/896.6; 52/673

[58] Field of Search ..... 72/327, 326, 333, 72/332, 335, 414; 29/896.6, 897.15; 52/673–675

[56] References Cited

U.S. PATENT DOCUMENTS

| | | | |
|---|---|---|---|
| 1,170,743 | 2/1916 | Evers | 52/675 |
| 1,979,748 | 11/1934 | Kimmel | 72/327 |
| 2,771,077 | 11/1956 | Karlsson | 29/896.6 |
| 3,245,465 | 4/1966 | Young | 72/327 |
| 3,279,043 | 10/1966 | Wirt | 29/896.6 |
| 4,150,556 | 4/1979 | Melnyk | 72/333 |

*Primary Examiner*—Daniel C. Crane
*Attorney, Agent, or Firm*—Gilberto M. Villacorta; Pepper Hamilton LLP

[57] ABSTRACT

A one-piece metal plate has an open mesh-like pattern, a plurality of identical rectangular perforations arranged at regular intervals in parallel rows, a plurality of identical rectangular embossed parts arranged at regular intervals and bridging the rows, and a plurality of identical rectangular web parts. Each of the embossed parts is raised relative to the web parts, and has two opposing overlapping ends extending into the rows. Each of the web parts is confined by two adjacent ones of the perforations and two adjacent ones of the embossed parts. The perforations are aligned along first lines which intersect the rows. The embossed parts are aligned along second lines parallel to the first lines. The first and second lines alternate with one another.

5 Claims, 6 Drawing Sheets

DIE ASSEMBLY FOR FORMING A PATTERN ON A METAL PLATE

FIELD OF THE INVENTION

The present invention relates to a die assembly, more particularly to a die assembly for forming a pattern on a metal plate.

BACKGROUND OF THE INVENTION

Referring to FIG. 1, a metal plate 1, which is used for forming a table top and the like, has a pattern with a plurality rows of rectangular perforations 2 in longitudinal and transverse directions. It is noted that the perforations 2 are formed by punching, and that the pattern formed on the metal plate 1 is not pleasant looking and provides a monotonous appearance.

SUMMARY OF THE INVENTION

Therefore, the object of the present invention is to provide a die assembly for forming a metal plate which has a unique pattern thereon such that the pattern simulates interwoven fabric pattern for enhanced aesthetic appeal.

Accordingly, a die assembly of this invention for forming a pattern on a metal plate includes a lower die unit, and an upper die unit. The lower die unit has a lower forming face adapted to support the metal plate thereon. The upper die unit is movable upward and downward so as to move toward and away from the lower forming face, and has an upper metal contact face. One of the lower forming face and the upper metal contact face has a plurality of projecting punching elements of identical rectangular cross-section adapted to perforate the metal plate, and a plurality of embossing holes of identical rectangular cross-section. The other one of the lower forming face and the upper metal contact face has a plurality of punching slots of identical rectangular cross-section to register with and receive the punching elements when the upper die unit moves toward the lower die unit, and a plurality of projecting embossing elements of identical rectangular cross-section to project into the embossing holes when the upper die unit moves toward the lower die unit. The punching slots are aligned at regular intervals in parallel rows. Each of the embossing elements bridges two adjacent ones of the rows of the punching slots, and has two opposing overlapping ends that extend into the rows.

A metal plate formed by the die assembly of the present invention has a plurality of identical rectangular perforations which are arranged at regular intervals in parallel rows, a plurality of identical rectangular embossed parts which are arranged at regular intervals to bridge the rows, and a plurality of identical rectangular web parts. Each of the embossed parts is raised relative to the web part and has two opposing overlapping ends that extend into the rows. Each of the web parts is confined by two adjacent ones of the perforations and two adjacent ones of the embossed parts. The perforations are aligned along first lines which intersect the rows. The embossed parts are aligned along second lines parallel to the first lines. The first and second lines alternate with one another.

BRIEF DESCRIPTION OF THE DRAWINGS

Other features and advantages of this invention will become more apparent in the following detailed description of the preferred embodiment of this invention, with reference to the accompanying drawings, in which.

DETAILED DESCRIPTION OF THE PREFERRED EMBODIMENT

Figure 1:
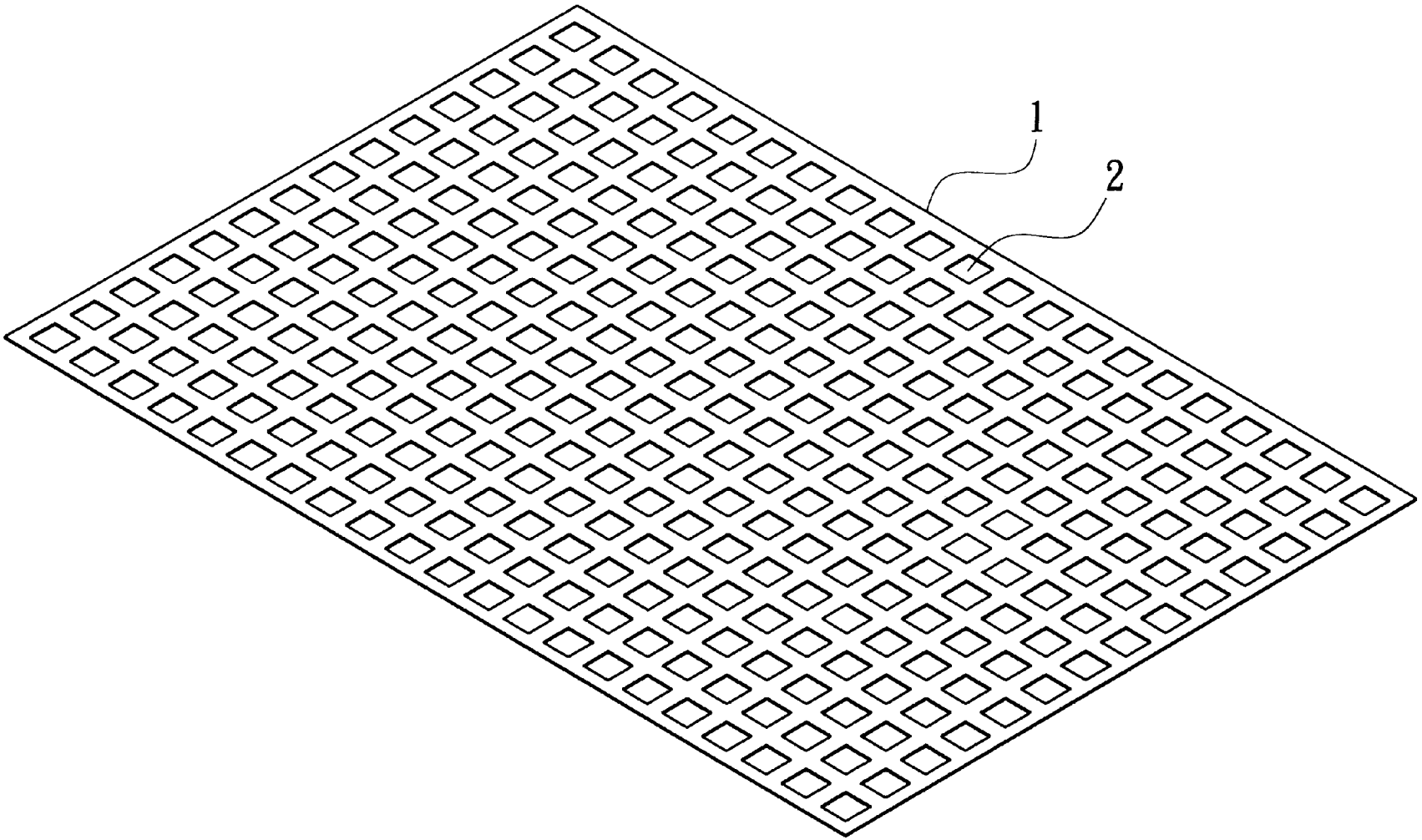
FIG. 1 is a perspective view of a metal plate with a known pattern formed thereon.
Figure 2:
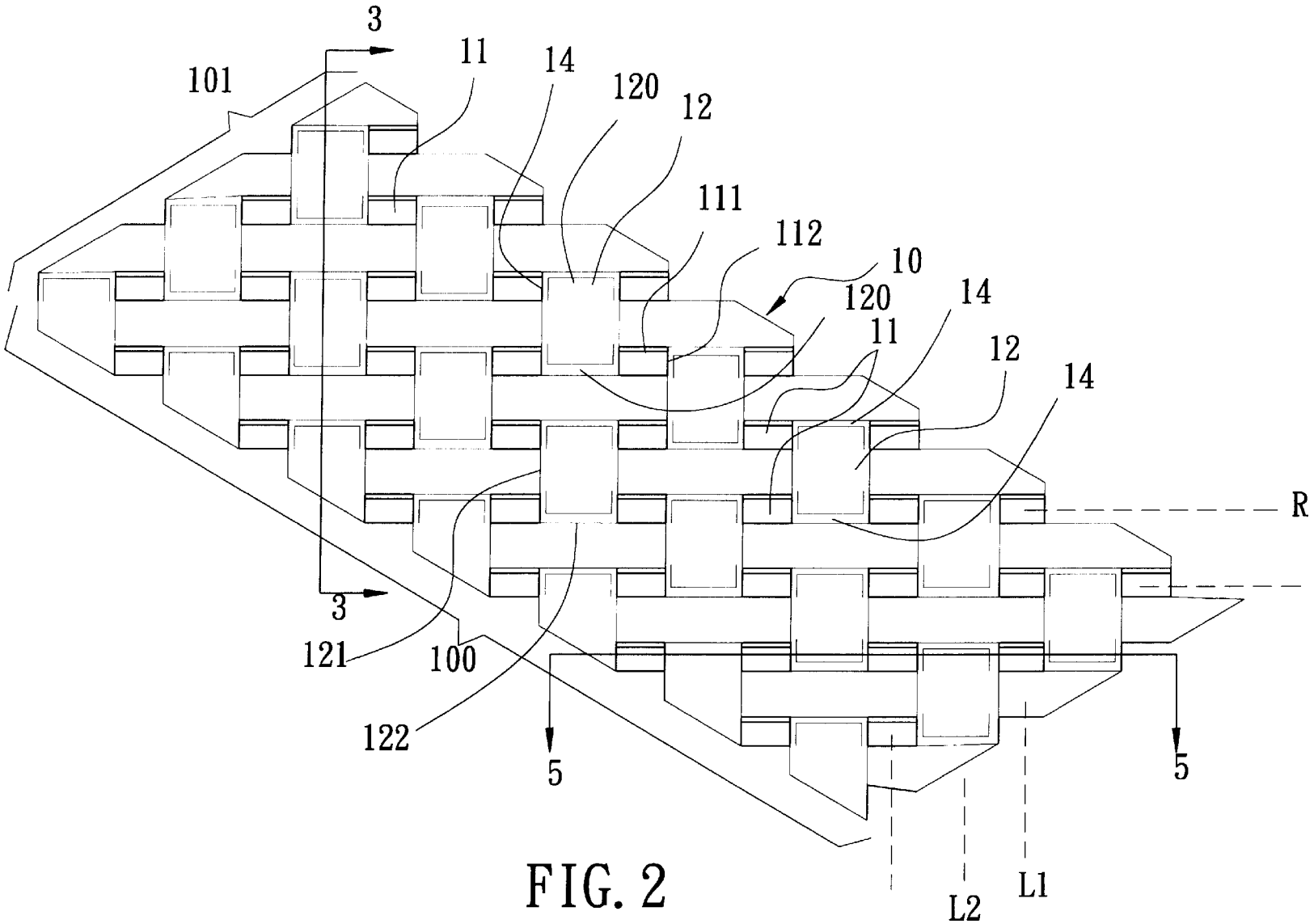
FIG. 2 is a perspective view of a metal plate with a unique pattern which is formed by a die assembly of the present invention.
Figure 3:
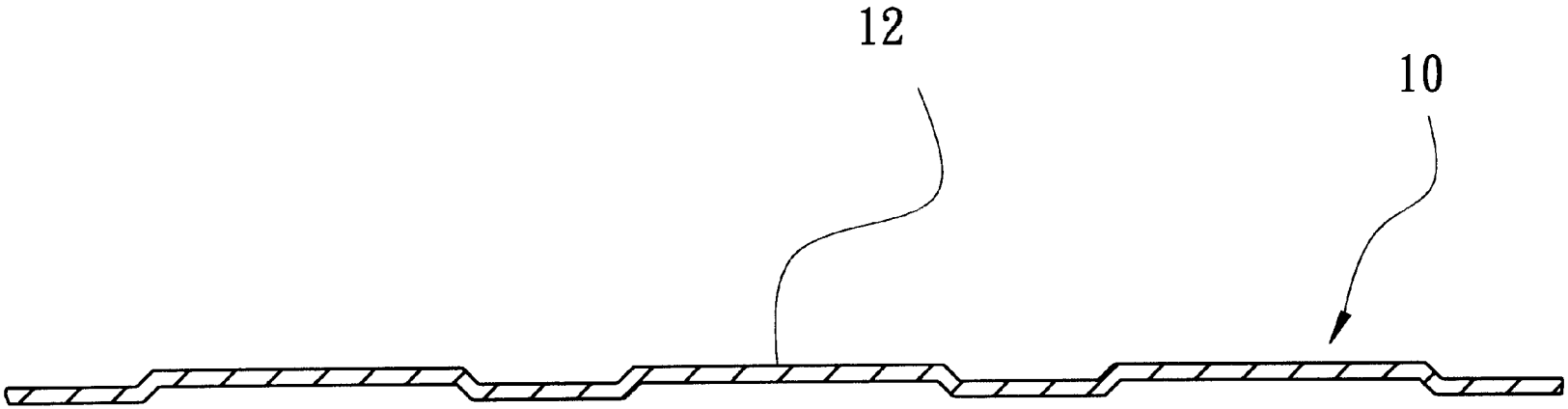
FIG. 3 is a cross-sectional view of the metal plate taken along lines 3—3 in FIG. 2.
Figure 4:
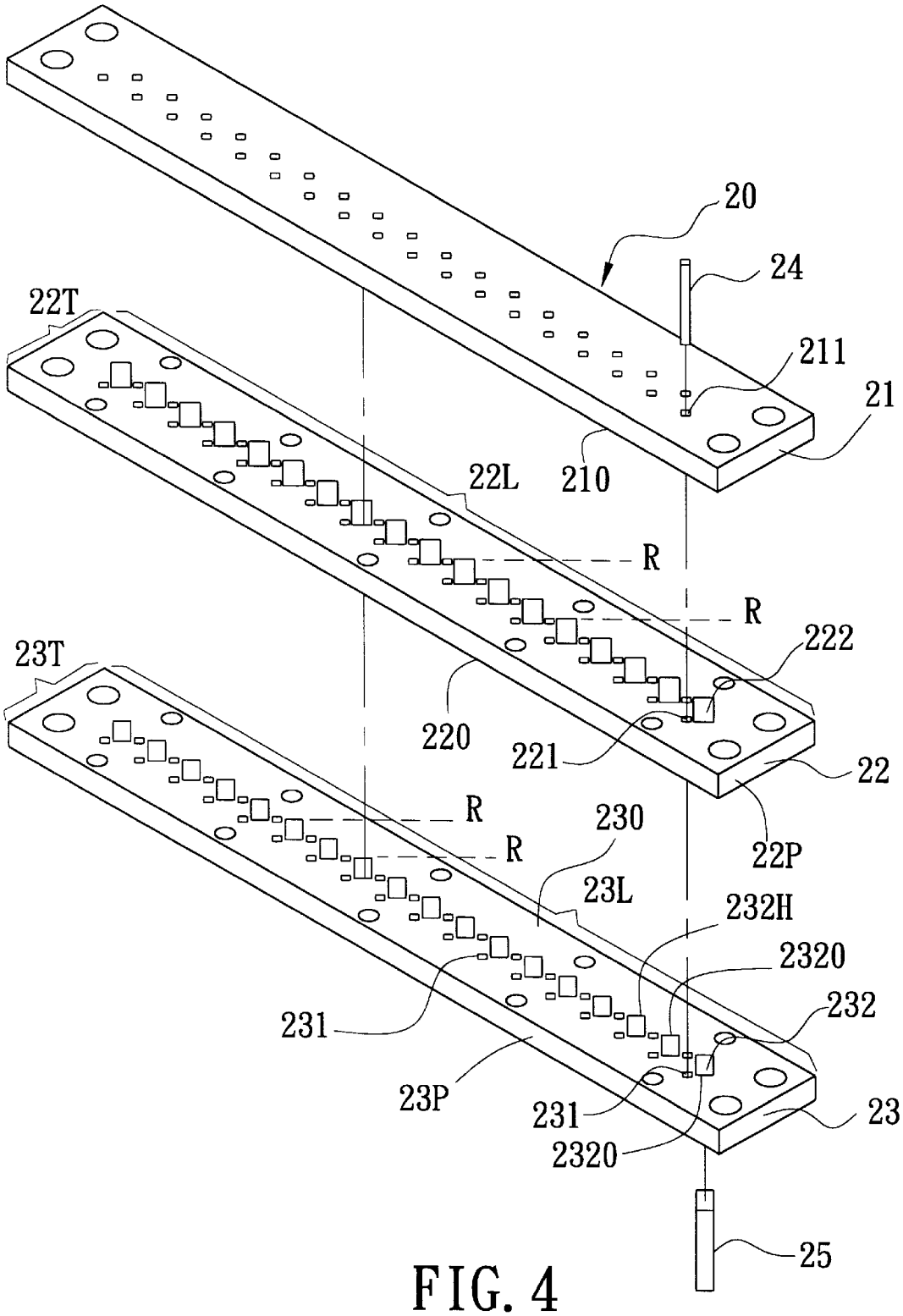
FIG. 4 is an exploded view of a die assembly of the present invention for forming the unique pattern on the metal plate shown in FIG. 2.

Referring to FIGS. 2, 3 and 4, a one-piece metal plate 10 is shown to have a unique pattern, such as an open mesh-like pattern which simulates an interwoven fabric structure and which is formed by a die assembly 20 of the present invention.

As illustrated, the metal plate 10 has a plurality of identical rectangular perforations 11 which are arranged at regular intervals in parallel rows (R), a plurality of identical rectangular embossed parts 12 which are arranged at regular intervals to bridge the rows (R), and a plurality of identical rectangular web parts 14. Each of the embossed parts 12 is raised relative to the web part 14 and has two opposing overlapping ends 120 that extend into the rows (R). Each of the web parts 14 is confined by two adjacent ones of the perforations 11 and two adjacent ones of the embossed parts 12. The perforations 11 are aligned along first lines (L1) which intersect the rows (R). The embossed parts 12 are aligned along second lines (L2) parallel to the first lines (L1). The first and second lines (L1, L2) alternate with one another.

Note the perforations 11 are elongated along the directions of the rows (R). The embossed parts 12 are elongated along directions parallel to the line which is perpendicular to the rows (R). The opposing overlapping ends 120 of each of the embossed parts 12 extend into the intervals of two adjacent ones of the rows (R). The metal plate 10 is rectangular, and has a pair of longitudinal sides 100 and a pair of transverse sides 101. The rows (R) of the perforations 11 extend along directions parallel to a line which inclines relative to the longitudinal and transverse sides 100, 101 of the metal plate 10.

Each of the perforations 11 has a pair of longitudinal sides 111 and a pair of transverse sides 112. Each of the embossed parts 12 has a pair of longitudinal sides 121 and a pair of transverse sides 122 that extend into the opposing overlapping ends 120, respectively. The transverse sides 122 in a respective one of the embossed parts 12 are interposed between two adjacent ones of the perforations 11 and are aligned with and connected to one of the longitudinal sides 111 of each of two adjacent ones of the perforations 11. The transverse sides 122 of the perforations 11 are bounded by portions of the longitudinal sides 121 in the overlapping portions 120 of the embossed parts 12.

The die assembly 20 accordingly includes a lower die unit 23 and an upper die unit 22. The lower die unit 23 has a lower forming face 230 adapted to support the metal plate 10. The upper die unit 22 is movable upward and downward so as to move toward and away from the lower forming face 230, and has an upper metal contact face 220. One of the lower forming face 230 and the upper metal contact face 220 has a plurality of projecting punching elements 24 of identical rectangular cross-section adapted to perforate the metal plate 10, and a plurality of embossing holes 222 of identical rectangular cross-section. The other one of the lower forming face 230 and the upper metal contact face 220 has a plurality of punching slots 231 of identical rectangular cross-section to register with and receive the punching elements 24 when the upper die unit 22 moves toward the lower die unit 23, and a plurality of embossing elements 232 of identical rectangular cross-section to project into the embossing holes 222 when the upper die unit 22 moves toward the lower die unit 23. The punching slots 231 are aligned at regular intervals in parallel rows (R). Each of the embossing elements 232 bridges two adjacent of the rows (R) of the punching slots 231, and has two opposing overlapping ends 2320 that extend into the rows (R). Each of the rows (R) includes two of the punching slots 231. Each of the embossing elements 232 has one of the overlapping ends 2320 extending into one of the intervals of the rows (R). Each of the overlapping ends 2320 has a width that extends in full length of one of the intervals.

The punching slots 231 are elongated along the direction of the rows (R). The embossing elements 232 are elongated along directions perpendicular to the rows (R). Each of the upper and lower die units 22, 23 is elongated, and has a pair of longitudinal sides (22L), (23L), and a pair of transverse sides (22T), (23T). The rows (R) of the punching slots 231 extend along directions parallel to a line which inclines with respect to the longitudinal sides (22L, 23L) and the transverse sides (22T, 23T).

In the preferred embodiment, the lower die unit 23 include an elongated lower die plate (23P) which has the lower forming face 230 and the punching slots 231. The embossing elements 232 employed herein includes a plurality of lower mounting holes (232H) formed in the lower forming face 230, and a plurality of rams 25 inserted securely in the lower mounting holes (232H) such that the rams 25 project upward from the lower forming face 230.

The upper die unit 22 includes an elongated first upper die plate (22P), and an elongated second upper die plate 21 superimposed and secured to the first upper die plate (22P). The first upper die plate 22P has the upper metal contact face 220, the embossing holes 222, and a plurality of passage holes 221 of rectangular cross-section. The second upper die plate 21 has a plurality of upper mounting holes 211. The punching elements 24 are inserted securely in the upper mounting holes 211 and project downwardly from the upper metal contact face 220 by passing through the passage holes 221 in the first upper die plate 22P.

Each of the lower, first and second upper die plates 23, (22P), 21 is rectangular, and has a pair of longitudinal sides, and a pair of transverse sides. The punching slots 231 are elongated along the direction of the rows (R). The embossing elements 232 are elongated along a direction which intersects perpendicularly the rows (R). Each of the rows (R) includes two of the punching slots 231. Each of the embossing elements 232 has one of the overlapping ends 2320 that extends into one of the intervals of the rows (R). The rows (R) of the punching slots 231 extend along directions parallel to a line which inclines with respect to the longitudinal and transverse sides (23L), (23T) of the lower die plate (23P).

Figure 5:
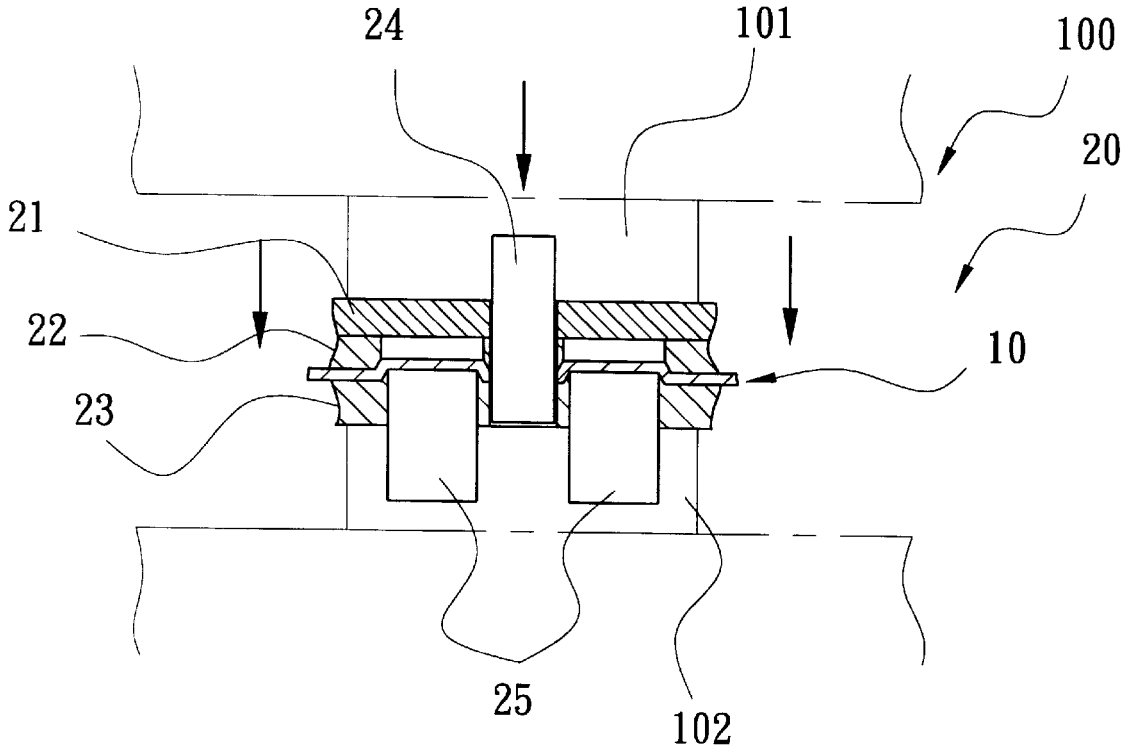
FIG. 5 illustrates how the die assembly of the present invention is mounted on a punching machine in order to form the unique pattern on the metal plate of FIG. 2.
Figure 6:
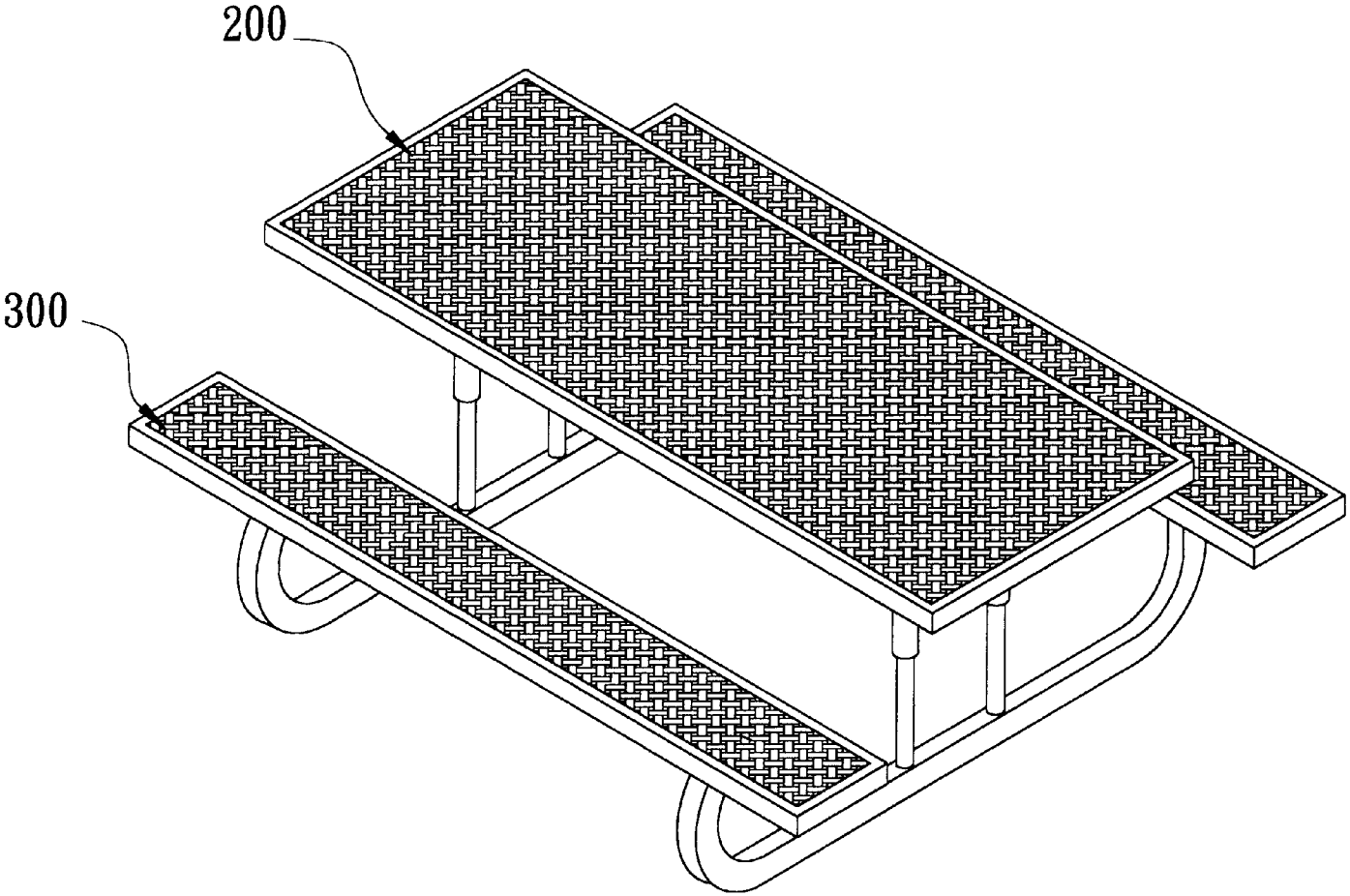
FIG. 6 is a perspective view of a furniture which employs elongated metal plates formed by the die assembly of the present invention.

FIG. 5 illustrates how the die assembly 20 of this invention is mounted on a punching machine 100 which includes a stationary support base 102 to receive the lower die unit 23 over which the metal plate 10 is provided, and a plunger 101 to which the first and second upper die plates 22, 21 are attached such that when the plunger 101 is moved continuously toward and away from the stationary support base 102, the metal plate 10 is formed with the unique pattern as shown in FIG. 2. FIG. 6 shows a piece of furniture in which metal plates 200, 300 are used. The metal plates 200, 300 have the unique patterns formed by the die assembly 20 of the present invention.

With this invention thus explained, it is apparent that numerous modifications and variations can be made without departing from the scope and spirit of this invention. It is therefore intended that this invention be limited only as indicated in the appended claims.

I claim:

1. A die assembly for forming a pattern on a metal plate, comprising:

a lower die unit having a lower forming face adapted to support the metal plate; and an upper die unit movable upward and downward so as to move toward and away from said lower forming face, said upper die unit having an upper metal contact face;

one of said lower forming face and said upper metal contact face having a plurality of projecting punching elements of identical rectangular cross-section adapted to perforate said metal plate, and a plurality of embossing holes of identical rectangular cross-section;

the other one of said lower forming face and said upper metal contact face having a plurality of punching slots of identical rectangular cross-section to register with and receive said punching elements when said upper die unit moves toward said lower die unit, and a plurality of projecting embossing elements of identical rectangular cross-section to project into said embossing holes when said upper die unit moves toward said lower die unit;

said punching slots being aligned at regular intervals in parallel rows, each of said embossing elements bridging two adjacent ones of said rows of said punching slots, and having two opposing overlapping ends extending into said rows; and wherein each of said rows includes two of said punching slots, each of said embossing elements having one of said overlapping ends extending into one of said intervals of said rows, each of said overlapping ends having a width that extends in full length of one of said intervals of said rows.

2. The die assembly as claimed in claim 1, wherein said punching slots are elongated along the direction of said rows, and said embossing elements are elongated along directions perpendicular to said rows.

3. The die assembly as claimed in claim 2, wherein each of said upper and lower die units is elongated, and has a pair of longitudinal sides and a pair of transverse sides, said rows of said punching slots extending along directions parallel to a line which inclines with respect to said longitudinal sides and said transverse sides.

4. A die assembly for forming a pattern on a metal plate, comprising:

a lower die unit having a lower forming face adapted to support the metal plate; and an upper die unit movable upward and downward so as to move toward and away from said lower forming face, said upper die unit having an upper metal contact face;

one of said lower forming face and said upper metal contact face having a plurality of projecting punching elements of identical rectangular cross-section adapted to perforate said metal plate, and a plurality of embossing holes of identical rectangular cross-section;

the other one of said lower forming face and said upper metal contact face having a plurality of punching slots of identical rectangular cross-section to resister with and receive said punching elements when said upper die unit moves toward said lower die unit, and a plurality of projecting embossing elements of identical rectangular cross-section to project into said embossing holes when said upper die unit moves toward said lower die unit;

said punching slots being aligned at regular intervals in parallel rows, each of said embossing elements bridging two adjacent ones of said rows of said punching slots, and having two opposing overlapping ends extending into said rows;

wherein said lower die unit includes an elongated lower die plate which has said lower forming face, said punching slots, and a plurality of lower mounting holes, said embossing elements being inserted securely in said lower mounting holes and projecting upward from said lower forming face; and wherein said upper die unit includes an elongated first upper die plate, and an elongated second upper die plate superimposed and secured to said first upper die plate, said first upper die plate having said upper metal contact face, said embossing holes, and a plurality of passage holes of rectangular cross-section, said second upper die plate having a plurality of upper mounting holes, said punching elements being inserted securely into said upper mounting holes and projecting downwardly from said upper metal contact face by passing through said passage holes.

5. The die assembly as claimed in claim 4, wherein each of said lower, first and second upper die plates is rectangular and has a pair of longitudinal sides, and a pair of transverse sides, said punching slots being elongated along the direction of said rows, said embossing elements being elongated along a direction intersecting perpendicularly said rows, each of said rows including two of said punching slots, each of said embossing elements having one of said overlapping ends extending into one of said intervals of said rows, said rows of said punching slots extending along directions parallel to a line.

* * * * *